US006771238B1

(12) United States Patent
Hiroki

(10) Patent No.: US 6,771,238 B1
(45) Date of Patent: Aug. 3, 2004

(54) LIQUID CRYSTAL DISPLAY DEVICE

(75) Inventor: Masaaki Hiroki, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/294,339

(22) Filed: Apr. 20, 1999

(30) Foreign Application Priority Data

Apr. 23, 1998 (JP) ..... 10-129488

(51) Int. Cl.[7] ..... G09G 3/36
(52) U.S. Cl. ..... 345/87; 345/88; 345/98
(58) Field of Search ..... 345/88, 100, 87, 345/98

(56) References Cited

U.S. PATENT DOCUMENTS

| | | | | |
|---|---|---|---|---|
| 4,180,813 A | | 12/1979 | Yoneda | |
| 4,263,616 A | * | 4/1981 | Lee | 358/166 |
| 4,296,435 A | * | 10/1981 | D'Hautecort et al. | 358/166 |
| 4,437,092 A | | 3/1984 | Dean et al. | |
| 4,488,150 A | | 12/1984 | Kanatani | |
| 4,581,631 A | | 4/1986 | Sonnenberger | |

(List continued on next page.)

FOREIGN PATENT DOCUMENTS

| | | |
|---|---|---|
| DE | 43 06 988 A1 | 3/1993 |
| EP | 0 457 329 A2 | 11/1991 |
| EP | 0 718 816 A2 | 6/1996 |
| JP | 62-008221 | 1/1987 |
| JP | 62-144235 | 6/1987 |
| JP | 63-014577 | 1/1988 |
| JP | 01-161581 | 6/1989 |
| JP | 01-234889 | 9/1989 |
| JP | 02-053392 | 2/1990 |
| JP | 02-168788 | 6/1990 |
| JP | 03-018176 | 1/1991 |
| JP | 03-126377 | 5/1991 |
| JP | 03-223894 | 10/1991 |
| JP | 7-121144 | 5/1995 |
| JP | 08-051584 | 2/1996 |
| JP | 8-78329 | 3/1996 |

OTHER PUBLICATIONS

Analog Devices, CMOS 220 MHz True–Color Graphics Triple 10–Bit Video RAM–DAC, ADV7150, pp. 1–34.
Jackson, "Unsharp Masking", pp. 13–22 Photographic/Electronic, GATFWORLD.
Molla, "Advantages and Disadvantages of Various Main and Unsharp Masking Aperture Ratios", pp. 230–232, 1998, Electronic Color Separtion.

*Primary Examiner*—Amr Awad
*Assistant Examiner*—Alecia D Nelson
(74) *Attorney, Agent, or Firm*—Eric J. Robinson; Robinson Intellectual Property Law Office, P.C.

(57) ABSTRACT

Disclosed is a high-definition liquid crystal display device wherein a video signal applied to the pixel electrode is compensated for a gain decrease in a high frequency range. A video signal processing circuit includes an inversion processing circuit which outputs at least one video signal inputted to a source driver circuit. The inversion processing circuit includes an amplifier and has function of amplification and inversion. A peaking processing circuit is connected to an amplifier in the inversion processing circuit. Even if a video signal frequency $f_{vid}$ is in a high range of the amplifier, the amplifier gain is increased up to an middle range value (frequency range that the gain becomes constant). Because the peaking circuit compensates for characteristics of the liquid crystal panel, it is possible for the inversion processing circuit to apply an alternating current signal reproduced with fidelity of a potential determined by a correction circuit to the liquid crystal cell.

26 Claims, 10 Drawing Sheets

U.S. PATENT DOCUMENTS 4,591,902 A 5/1986 Masubuchi
4,593,310 A 6/1986 Songer
4,698,666 A 10/1987 Lake, Jr. et al.
4,766,430 A 8/1988 Gillette et al.
4,839,836 A 6/1989 Fonsalas
4,842,371 A 6/1989 Yasuda et al.
4,859,998 A 8/1989 Kawamura et al.
5,017,914 A 5/1991 Uchida et al.
5,099,230 A 3/1992 Fujii
5,140,315 A 8/1992 Edelson et al.
5,153,568 A 10/1992 Shaw
5,157,386 A 10/1992 Uchida et al.
5,237,414 A 8/1993 Faroudja
5,247,352 A 9/1993 Nagler et al.
5,321,511 A 6/1994 Min
5,406,304 A 4/1995 Shirayama
5,598,180 A 1/1997 Suzuki et al.
5,600,345 A * 2/1997 Dingwall et al. ..... 345/100
5,604,511 A 2/1997 Ohi
5,638,087 A * 6/1997 Tanaka et al. ..... 345/87
5,721,563 A * 2/1998 Memida ..... 345/98
5,748,164 A 5/1998 Handschy et al.
5,780,872 A 7/1998 Misawa et al.
5,790,092 A 8/1998 Moriyama
5,801,791 A 9/1998 Yamazaki et al.
5,825,434 A 10/1998 Yamazaki et al.
5,847,688 A 12/1998 Ohi et al.
5,889,503 A * 3/1999 Kikuchi et al. ..... 345/98
6,049,321 A 4/2000 Sasaki
6,054,976 A * 4/2000 Kubota et al. ..... 345/100
6,097,352 A 8/2000 Zavracky et al.
6,166,725 A 12/2000 Isami et al.
6,628,253 B1 9/2003 Hiroki

* cited by examiner

LIQUID CRYSTAL DISPLAY DEVICE

BACKGROUND OF THE INVENTION

1. Field of the Invention

The present invention relates to active matrix liquid crystal display devices incorporating therein driver circuits, and more particularly to a technology to enhance definition and image quality for the liquid crystal display devices.

2. Description of Related Art

In recent years, technological developments have being put forwarded in flat panels, such as liquid crystal displays (LCD), plasma display panels (PDP), electroluminescence (EL) displays, as cathode ray tubes (CRT) replacing displays. Among these flat displays, liquid crystal displays are the largest in marketplace and utilized for various display mediums including notebook personal computers, digital cameras with liquid crystal panels, car navigation systems, projectors and wide screen televisions.

The advantage of the liquid crystal display greater than the CRT lies in that the display area is obtained wide due to display section flatness and high definition given by the dot matrix display scheme.

The high definition is meant to increase in the number of pixels in the liquid crystal display. A drive frequency increases with increase in the number of pixels. For example, the number of pixels, although about four hundreds of thousands in NTSC rating, mounts to approximately two millions (1920×1080 pixels), in HDTV rating. Accordingly, in HDTV rating the input video signal has its maximum frequency reaching as high as 20 to 30 MHz, despite it was 6 MHz in the NTSC rating.

In order to display video signals with accuracy, a clock signal requires a frequency of several times (e.g., about 50 to 60 MHz) that of the video signal. It is expected that display with higher definition and image quality be furthermore required from now on and video signals with a dot clock extremely high in speed be dealt with.

FIG. 11A shows a simplified routes for video signals to be inputted to the conventional liquid crystal display panel. The liquid crystal display panel 10 is arranged, as shown in FIG. 11A, with a pixel matrix area 11, and a gate driver circuit 12 and a source driver circuit 13. The gate driver circuit 12 is also called a scanning line driver circuit. The source driver circuit 13 is also called a signal line driver circuit or a data line driver circuit. The pixel matrix area 11 has pixels, each pixels having a liquid crystal cell 15 and a pixel TFT 16. The liquid crystal cell 15 possesses a capacitor structure having dielectric sandwiched between a pixel electrode to be inputted by a video signal and an opposite electrode. The pixel TFT 16 includes a gate electrode, a source electrode and a drain electrode. The gate electrode is connected to a scanning line 17, the source electrode (or the drain electrode) is connected to a signal line 18 and the drain electrode (or the source electrode) is connected to the pixel electrode of the liquid crystal cell 15. The scanning line 17 is connected to the gate driver circuit 12 and the signal line 18 is connected to the source driver circuit 13. The scanning line 17 is also called a gate line. The signal line 18 is also called a data line, a source line or a drain line.

The video signal to be applied to the pixel cell is processed suitably for display characteristics of the liquid crystal panel 10 by the video signal processing circuit 20. The video signal processing circuit 20 mainly performs gamma correction, alternation and amplification to process on video signals inputted from the outside. The processed video signal is inputted from the source driver circuit 13 through the signal line 18 to the pixel matrix area 11, thus applied to the pixel electrode of the liquid crystal cell 15. The liquid crystal material in the liquid crystal cell 15 varies in light transmission rate depending upon a voltage applied to. The change of light transmission rate corresponds to tone whereby images are formed by the entire liquid crystal cells 15.

In order to realize high quality display on the liquid crystal panel, the video signal processing circuit 20 requires an amplifier 21 (see FIG. 11B) to amplify signal waveforms with fidelity. This is because the amplifier 21 is at a final output end of the video signal processing circuit 20 where the video signal to be applied to the pixel electrode of the liquid crystal cell 15 is finally determined in amplitude and form. The video signal applied to the pixel electrode is a pulse-formed signal. Consequently, the amplifier 21 is required not to cause pulse signal amplitude deterioration and rounding of pulse waveforms.

It is known that the amplifier 21 generally has a frequency characteristic as shown in numeral 1101 of FIG. 11C wherein a voltage gain is nearly constant in a middle range but, in a range exceeding a certain frequency, decreases at a constant rate. The decrease rate is −20 dB/decade (−6 dB/octave) where the amplifier is in one stage. The cause of decreasing the gain in the higher range is due to output impedance increase in the single amplifier.

In the liquid crystal display, however, consideration has to be given not only to the output end voltage of the amplifier 21 but also to the voltage finally applied to the pixel electrode. Accordingly, there is a necessity for the frequency characteristic of the amplifier 21 in the video signal processing circuit to consider also the resistance $R_{LC}$ and capacitance $C_{LC}$ connected between the amplifier 21 and the liquid crystal cell 15 instead of the single amplifier 21. Thereupon, as shown in numeral 1102 of the FIG. 11C the frequency range in which the gain of the pixel electrode of the liquid crystal cell 15 begins to lower is shifted to a lower side than the gain of the single amplifier 21 by impedance decrease due to the liquid crystal panel resistance $R_{LC}$ and capacitance $C_{LC}$.

The increase of definition in the liquid crystal display is pixel and pixel density increase. The pixels, if increased, increases the number of connection lines, increasing liquid panel resistance $R_{LC}$. The density increase actualizes; the problem of pixel matrix parasitic capacitance, giving rise to a tendency of increasing the capacitance $C_{LC}$. Accordingly, the increase of definition results in a shift of the frequency range in which the gain of the amplifier 21 is flat toward the lower range side. In order to avoid the gain decrease, the resistance $R_{LC}$ may be decreased. In order to reduce the resistance $R_{LC}$, the thickness of interconnection may be increased. However, the increase in interconnection thickness leads to increase in interconnect occupation area, running counter to a direction of a technological development called pixel shrinkage.

The increase in definition also requires high frequency drive. The video signal drive frequency in the HDTV rating requires as high as 20 to 30 MHz. If an HDTV rating display is realized by a liquid crystal panel, the video signal frequency $f_{vid}$ unavoidably comes to a frequency range that the gain on the pixel electrode is decreased due to the above-described increase in definition of the liquid crystal panel.

If a gain decrease on the pixel electrode occurs in the video signal frequency $f_{vid}$, the video signal decreases in black or white level, resulting in image graying (muddy color in color display) and hence degradation in display quality.

High frequency drive has been unnecessary for such a VGA or SVGA rated liquid crystal panel as having the horizontal number of pixels of less than a thousand. Consequently, even if there has been a decrease on the high frequency side in the gain of the voltage applied to the pixel electrode, the amplifier 21 could be used at a frequency at which the gain is flat. The problem of the gain decrease concerning the frequency has not been recognized at all.

SUMMARY OF THE INVENTION

It is an object of the present invention to provide a liquid crystal display device which is capable of displaying with high quality, wherein the gain reduction in the high frequency range is compensated for the video signal to be applied to pixel electrodes of a pixel matrix area to eliminate the above-described problem due to increase in definition for the display device.

According to a structure of the present invention, a liquid crystal display device, at least comprises: a pixel matrix area having a switching element for each pixel electrode; a first driver circuit connected to scanning lines of the pixel matrix area; a second driver circuit connected to signal lines of the pixel matrix area; a video signal processing circuit for alternating video signals and outputting a plurality of alternating video signals onto the second driver circuit; and a control circuit for creating control signals to control on drive to the first driver circuit, the second driver circuit and the video signal processing circuit; wherein the video signal processing circuit has a circuit for effecting a peaking process connected to an output of an amplifier placed at the closest to each output terminal outputting the alternating current video signals.

According to another structure of the invention, the video signal processing circuit converts the video signals into the alternating current video signal and outputs the alternating current video signals to the second driver circuit. The alternating current signals are constituted by two kinds of alternating current signals in an inverted relation to each other. The video signal processing circuit has a circuit for effecting a peaking process connected to an output of an amplifier placed at the closest to each output terminal outputting the alternating current video signals.

In the liquid crystal display device of the invention, a peaking processing circuit is connected to an output of the amplifier placed at the closest to an output terminal outputting the video signals. This makes it possible to display in high definition display by compensating for voltage gain on the pixel electrodes due to reduction in impedance loaded on the amplifier, i.e., impedance of the pixel matrix area or driver circuit.

DETAILED DESCRIPTION OF THE INVENTION

The invention will now be described with reference to FIG. 1 through FIG. 4.

Figure 1:
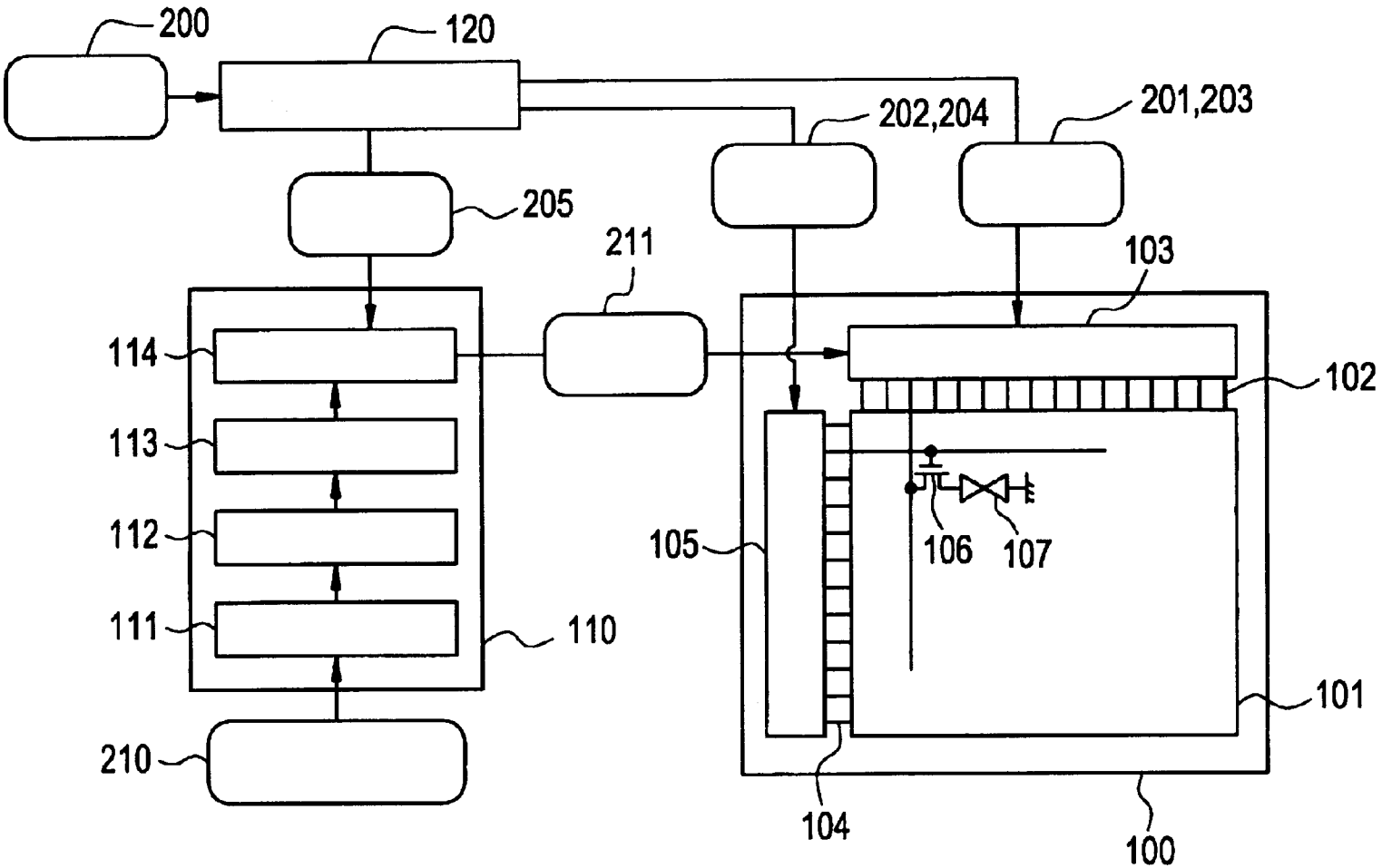
FIG. 1 is a block diagram showing a constitution of a liquid crystal display device according to the present invention.

Referring first to FIG. 1, there is shown a block diagram of a liquid crystal display device according to the present invention. The liquid crystal display device includes a liquid crystal panel 100 to display images, a video signal processing circuit 110 to render an input video signal into an alternating current form, and a control circuit 120 to control the liquid crystal panel 100 as well as video signal operation timing.

In the liquid crystal panel 100, a pixel matrix area 101 is connected with a source driver circuit (a signal line driver circuit) 103 through a plurality of signal lines 102 vertically extending in parallel with each other, and with a gate driver circuit (a scanning line driver circuit) 105 through a plurality of scanning lines 104 horizontally extending in parallel with each other.

The pixel matrix area 101 is formed, on a pixel-by-pixel basis, with TFTs (thin film transistors) 106 as switch elements each arranged close to an intersection of a signal line 102 and a scanning line 104 and a liquid crystal cell 107 connected to the TFT 106. The scanning line 104 is connected at its one end to a gate electrode of a corresponding TFT, while the signal line 102 is connected at its one end to a source electrode or a drain electrode of the TFT. The liquid crystal cell 107 is formed with a capacitor by a pixel electrode, an opposite electrode and a liquid crystal material sandwiched between the pixel electrode and the opposite electrode. The opposite electrode is made common for all the liquid crystal cells 107, and has its potential held at a common potential (center potential).

The driver circuits 103, 105 are formed by TFTs and so on. Polycrystalline silicon films crystallized from amorphous silicon films are suitably employed for the TFTs of the driver circuits 103, 105 and TFT 106 in view of a field effect mobility. It is also possible to use a film crystallized from an amorphous silicon-germanium film.

The video signal processing circuit 110, the control circuit 120, etc. are mounted on a different substrate from the liquid crystal panel 100, e.g., on another printed substrate. The circuits on that substrate and the circuits on the liquid crystal panel 100 are connected through cables, flexible circuit boards, or the like. Incidentally it is needless to say that it is preferred in view of integration to arrange a part or the entire of a peripheral circuit including the video signal processing circuit 110 and the control circuit 120 on the same substrate as the liquid crystal panel.

The video signal processing circuit 110 has an A/D (analog/digital) converter 111, a correction circuit 112, a D/A (digital/analog) converter 113 and an inversion processing circuit 114. The control circuit 120 is a circuit to create pulses (start pulse, clock pulse, synchronous signal, polarity inversion signal, etc.) for controlling timing to operate the source driver circuit 103, the gate driver circuit 105, the video signal processing circuit 110, and so on based on the synchronization signal 200.

The source driver circuit 103 is inputted by a video signal having been rendered in an alternating current form by the video signal processing circuit 110, a start pulse signal, clock signal, horizontal synchronization signal, etc. from the control circuit 120. The operation of the liquid crystal display device in the present embodiment is explained below.

The control circuit 120 repeats an operation (frequency divisions) to count a clock with a previously set count number (frequency division ratio) on an synchronized oscillation clock signal (OSC) as a source oscillation outputted from an oscillator phase-synchronized, on the basis of an input synchronous signal 200 as a reference simultaneously with this frequency division, the clock is counted to create a start pulse (SPD) 201 in a screen horizontal direction, a start pulse (SPS) 202 in a screen vertical direction, a clock pulse (CLD) 203 in the screen horizontal direction, a clock pulse (CLS) 204 in the screen vertical direction, and a polarity reversal signal (FRP) 205. Further, there are cases to create a horizontal synchronization signal (HSY) and a vertical synchronization signal (VSY), wherein HSY and VSY are used as a reference in a horizontal or vertical direction for displaying characters on the screen.

The input video signal 210 to be inputted from the outside of the display device is an RGB analog signal having a video data pair of red (R), green (G) and blue (B) for each pixel unit, which is transferred to the video signal processing circuit 110 every unit time. The input video signal 210 is also a continuous signal continuous in the vertical number of lines, which has one screen (one frame) video signal divided by the number of lines in the vertical direction.

Correspondingly to the input video signal 210, the pixel matrix area 101 has R, G and B pixels which are repeatedly placed in the order in the horizontal direction correspondingly to different three colors of red, green and blue, thereby vertically constituting a pixel array. For example, if the pixel matrix area 101 is considered to be configured by horizontally 1024 pixels and vertically 768 pixels, then one screen video signal be formed by a continuous signal having, in the vertical number (768 columns) of lines, horizontal lines each including horizontally 1024 pixel information signals. In usual cases, the input video signal 210 is a signal corresponding to a CRT, but not suited for a liquid crystal panel. Due to this, the video signal processing circuit 110 performs various signal processing on the input video signal 210.

In the video signal processing circuit 110, the input video signal 210 is converted into a digital RGB signal by an A/D converter 111 and outputted to the correction circuit 112. In the correction circuit 112, the video signal in the digital signal form is subjected to gamma correction and the like regarding the characteristic of a liquid crystal material thus being improved in tone characteristic. The corrected video signal is again converted into an analog RGB signal by the D/A converter 113.

To digitize the video signal 210 by the A/D converter 111 is due to enabling the correction with easiness and accuracy by the correction circuit 112. Note that the A/D converter 111 can be omitted in the case of the input video signal 210 be a digital signal.

The corrected video signal is then amplified to a potential suited for the liquid crystal panel (generally, −5V to 5V) by the inversion processing circuit 114. That is, the corrected video signal is made into an alternating current form by reversing its polarity accordingly to a pulse potential of polarity reversal signal (FRP) 205 inputted from the control circuit 120 to the inversion processing circuit 114.

The source driver circuit 103 for the liquid crystal panel 100 is inputted by SPD 201 and CLD 203 created by the control circuit 120, together with the video signal 211 in the alternating current form. The SPD 201 is a pulse signal to define in which timing of one horizontal time period display is to start. The CLD 203 is a pulse signal corresponding to each pixel in the horizontal direction. According to this signal, the source driver circuit 103 performs sampling on the video signal 211 in the alternating current form and then outputs a voltage (video signal) corresponding to each pixel onto the signal line 102.

The gate driver circuit 105 is inputted by the SPS 202 and CLS 204 created by the control circuit 120. The SPS 202 is a pulse signal to define in which timing of one vertical time period display is to start. The CLS 204 is a pulse signal corresponding to each pixel in the vertical direction. The gate driver circuit 105 selects, every one horizontal period, a scanning line 104 to the pixel matrix area 101 in an order from above, thus displaying images.

Figure 11A:
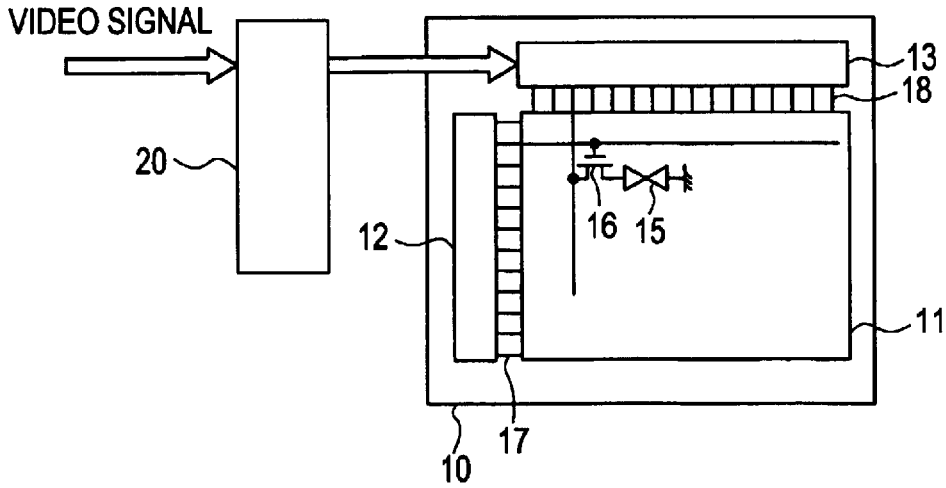
FIG. 11A PRIOR ART
FIGS. 11A, 11B and 11C are prior art explanatory views.
Figure 11B:
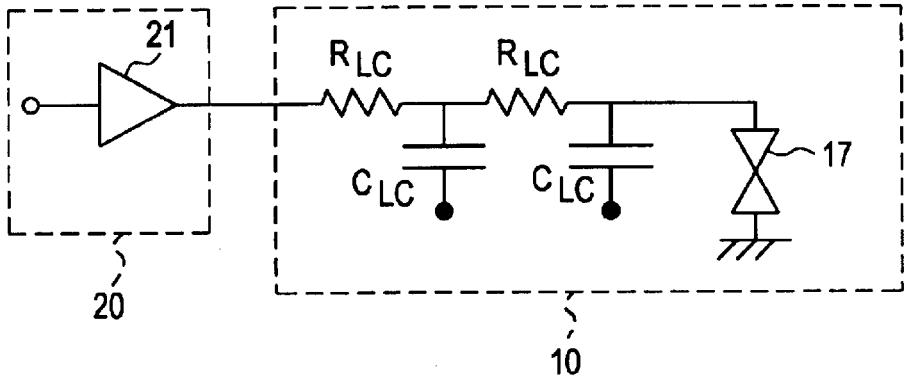
FIG. 11B PRIOR ART
Figure 11C:
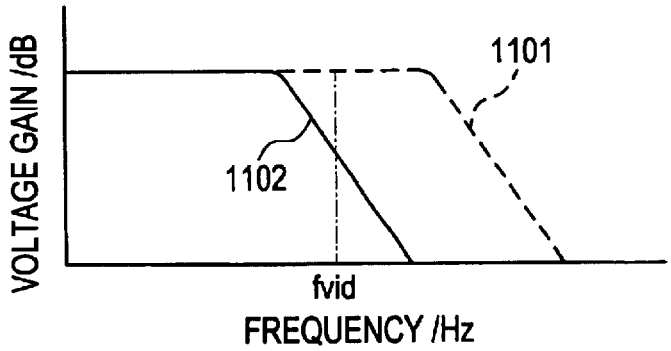
FIG. 11C PRIOR ART

The inversion processing circuit 114 of the video signal processing circuit 110 is a circuit to perform amplification and inversion processing, which is basically configured by an amplifier. As shown in the conventional example (see FIG. 11C), amplifier has a characteristic that on a high range side the voltage gain decreases with increase in the frequency. If the frequency $f_{vid}$ of a video signal to be processed is higher than 20 MHz, the gain is decreased in the signal applied to a pixel electrode of the liquid crystal cell 107 even at such a frequency that the gain is constant in the amplifier of the inversion processing circuit 114. Because, resistors or capacitors are existed in the liquid crystal panel 100 connected to the output of the inversion processing circuit 114. This makes it impossible to apply the data of the digital video signal having been corrected by the correction circuit 112 to the pixel electrode with fidelity.

For high quality display, the alternating current video signal 211 applied to the pixel electrode of the liquid crystal cell 107 requires reproduction with fidelity on the input video signal 210. Also, because the alternating current video signal 211, if inputted to the source driver circuit 103, is divided by signal lines 102, the correction to the entire alternating current video signal 211 is carried out by the video signal processing circuit 110. Consequently, the correction to a voltage gain in the pixel electrode is also conducted by the video signal processing circuit 110 as a prior stage to the source driver circuit 103. It is preferred in the video signal processing circuit 110 to compensate for decreasing of the voltage gain in the voltage to be applied to the pixel electrode by a circuit as close as possible to the liquid crystal cell 107. In the present invention, the output signal of the inversion processing circuit 114 to be finally inputted to the liquid crystal panel is the video signal 211, and accordingly the inversion processing circuit 114 is a closest amplifier to an output end of the alternating current video signal 211.

Figure 2:
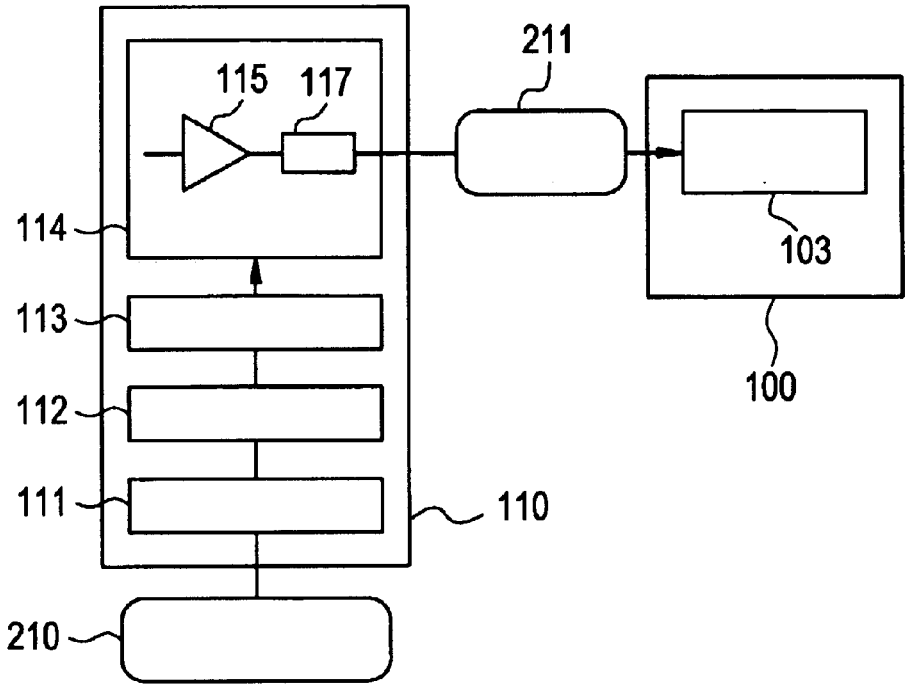
FIG. 2 is a partial block diagram showing a constitution of an inversion processing circuit.
Figure 3:
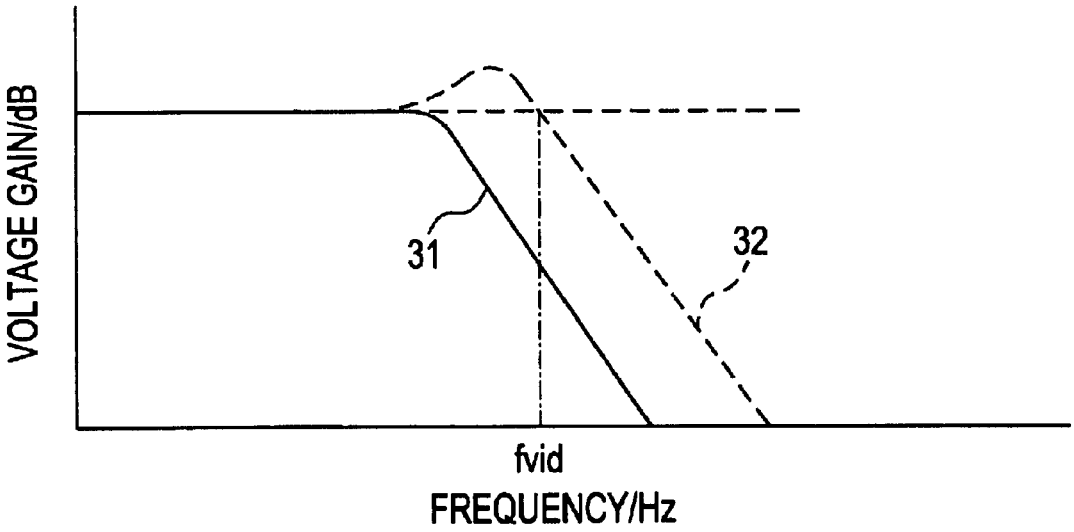
FIG. 3 is a diagram showing a frequency characteristic of an amplifier in the inversion processing circuit in FIG. 2.

In order to compensate for decreasing of the gain in the liquid crystal cell 107, a peaking processing circuit 117 is connected to the output of an amplifier 115 of the inversion processing circuit 114 to carry out a peaking process, as shown in FIG. 2. FIG. 3 shows the relation between frequency and voltage gain with regard to the alternating current video signal applied to a pixel electrode. In the case of the peaking processing circuit 117 is not connected as shown in the numeral 31 of the FIG. 3, the voltage gain of the signal at the video signal frequency $f_{vid}$ applied to the pixel electrode of the liquid crystal cell 107 is decreased. In the case of the peaking processing circuit 117 is connected to the output of the amplifier 115 as shown in the numeral 32 of the FIG. 3, the voltage gain of the signal at the video signal frequency $f_{vid}$ applied to the pixel electrode is increased up to a gain in a middle range (the frequency range constant in gain). Incidentally, the characteristic of the peaking processing circuit 117 was determined to compensate for the decrease of the voltage due to load impedance (the impedance possessed by the liquid crystal panel 100) by the amplifier 115.

The peaking processing circuit 117 is a means to compensate for the characteristic of the liquid crystal panel 100, wherein it is most important to connect it to the amplifier 115 positioned closest to the output terminal of the video signal processing circuit 110. By connecting the peaking processing circuit 117 to the output of the amplifier 115, the alternating current video signal corrected by the peaking processing circuit 117 can be inputted to the source driver circuit 113 with possibly reduced disturbance. Due to this, it becomes possible to apply with fidelity an alternating current video signal 211 reproduced of a potential determined by the correction circuit 112 to the pixel electrode of the liquid crystal cell 107.

Figure 4:
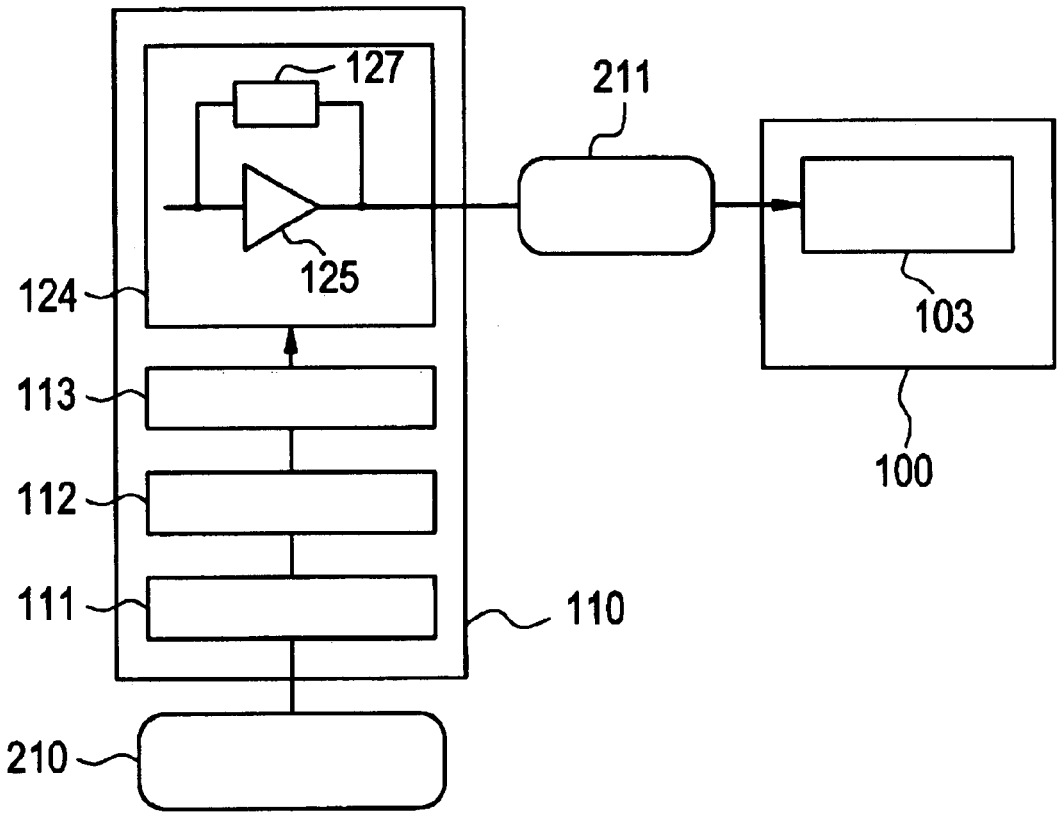
FIG. 4 is a partial block diagram showing a constitution of the inversion processing circuit, which is a modification of FIG. 2.

Also, even if a feedback circuit is provided at the output of the amplifier 125 of the inversion processing circuit 124 and the feedback circuit is configured by a peaking processing circuit as shown in FIG. 4, it is possible to obtain the same effect as the inversion processing circuit 114 of the FIG. 2. In the FIG. 4, same reference numerals denote same constituent components. The FIG. 4 is a modification of the inversion processing circuit 114 of the FIG. 2.

In order to improve the decrease of the gain on a high range side of the applied voltage to the pixel electrode, devising is required to reduce the resistance or capacitance in the liquid crystal panel 100. However, it is quite difficult in a highly definition panel having pixels vertically in number exceeding one thousand to improve the decrease of the gain through panel design or manufacture technology. Although interconnections, requires low resistance material selection, interconnect width increase and so on, they are difficult to practically apply due to the pixel shrinkage and processing problems as stated before thus resulting in deterioration in display characteristics. Accordingly, the problem of the gain decrease is quite difficult to eliminate by the liquid crystal panel design or process technology improvement. Meanwhile, the problem of the gain decrease can be easily dissolved by the peaking processing circuit 117 of the present invention.

The gain decrease in the video signal was improved herein by connecting the peaking processing circuit 117 to an output terminal of the video signal processing circuit 110. Amplitude decrease and pulse waveform rounding are caused in start pulse or clock pulse signals due to liquid crystal panel characteristics. Such amplitude decrease and pulse waveform rounding of the pulse signal can be prevented by connecting the peaking processing circuit also to an amplifier connected to an output end of the liquid crystal panel 100 of the control circuit 120, or an amplifier closest to an output end of a start pulse signal 202, 201 or clock pulse signal 203, 204, as shown in the FIG. 1 and the FIG. 5.

For example, where in the liquid crystal panel 100 the pixel TFTs 106 for the pixel matrix area 101 are varied in threshold from pixel to pixel, the pixel TFTs 106 are different in turning-on voltage. If the pulse waveform becomes round, inclination is caused in the signal-waveform rise portion. Accordingly, if there is variation in threshold voltage, the timing of turning on the TFTs deviates thereby putting image display timing out of order.

On the other hand, if the pulse signal is in rectangular, the TFTs are brought into coincidence in the timing of turning on even if there are somewhat variations in TFT threshold voltage. By preventing the pulse waveform from rounding by the provision of the peaking processing circuit 117, it is possible to relax the threshold voltage characteristics required for the TFTs in the liquid crystal panel 100 and hence reduce the number of liquid crystal panels having poor conditions.

Embodiments of the present invention are described using FIG. 5 to FIG. 10.

[Embodiment 1]

Figure 5:
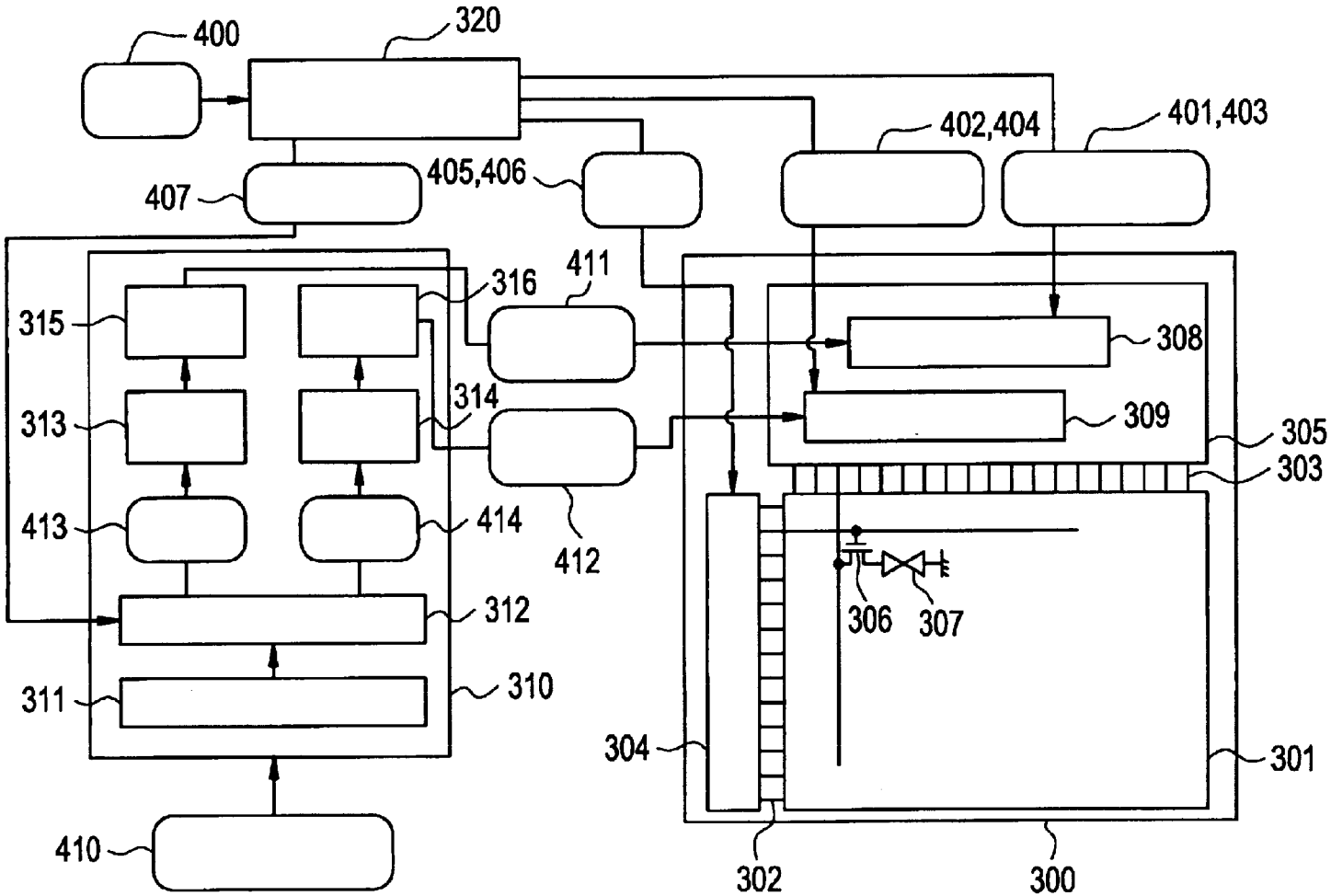
FIG. 5 is a block diagram showing a constitution of the liquid crystal display device of Embodiment 1.

Referring to FIG. 5, there is illustrated a block diagram showing a constitution of the liquid crystal display device according to the present embodiment. The liquid crystal display device comprises a liquid crystal panel 300 of a type integral with peripheral driver circuits, a video signal processing circuit 310 and a control circuit 320.

Here, the video signal processing circuit 310, the control circuit 320, etc. are mounted on a different substrate from the liquid crystal panel 300, e.g., on a printed substrate. The different substrate and the liquid crystal panel 300 are connected by cables, flexible circuit boards, or the like. Incidentally, it is needless to say that it is preferred from a integration view point to structure a part or the entire of peripheral circuits, including the video signal processing circuit 310 and the control circuit 320 on the same substrate as the liquid crystal panel.

The liquid crystal panel 300 has a pixel matrix area 301 having a plurality of scanning lines 302 horizontally extending in parallel with each other and a plurality of signal lines 303 vertically extending in parallel with each other and perpendicular to the scanning lines 302. The scanning lines 302 are connected to a gate driver circuit 304, while the signal lines 303 are connected to a source driver circuit 305.

The pixel matrix area 301 is formed, on a pixel-by-pixel basis, with thin film transistors 306. Each of the thin film transistors 306 is arranged close to an intersection of the scanning line 302 and the signal line 303 and liquid crystal cell 307 connected to each of the thin film transistors 306. The thin film transistors 306 are utilized as switch elements. The gate driver circuit 304 and the source driver circuit 305 include thin film transistors. The thin film transistors constituting for the pixel matrix area 301, the gate driver circuit 303 and the source driver circuit 305 are formed by using a polycrystalline silicon films or the like as a semiconductor material. The polycrystailline silicon film was obtained by heating an amorphous silicon film formed on a quartz substrate to which nickel was added for the purpose of promoting crystallization of the amorphous silicon, according to a technology described in Japanese laid-open patent publication No. 8-78329 (the laid-open date is Mar. 22, 1996), an entire disclosure of which is incorporated herein by reference. Thus, thin film transistors were formed based on the technology of the patent publication. The semiconductor material has no especial limitation provided that having a crystallinity and good field effect mobility. It is possible to use a film obtained by crystallizing an amorphous germanium-silicon film.

The liquid crystal cell 307 has a capacitor structure formed by a pixel electrode connected to the drain (or the source) of the TFT 306, an opposite electrode and a liquid crystal material sandwiched between the pixel electrode and the opposite electrode. The opposite electrode is common to the liquid crystal cells of all pixels and have a common potential (center potential).

The scanning line 302 has one end connected to the gate electrode of a corresponding TFT and the other end connected to the gate driver circuit 304. Also, the signal line 303 has one end connected to the source electrode of the TFT and the other end connected to the source driver circuit 305.

It should be noted that although in FIG. 5 the signal lines 303 are depicted in a not-many number, they practically in the same number as the number of pixel electrodes in the horizontal direction of the pixel matrix area 301. Similarly, the scanning lines 302 are in the same number as the number of pixel electrodes in the vertical direction of the pixel matrix area 301.

The control circuit 320 creates and outputs pulse signals required to drive the liquid crystal panel (start pulse, clock pulse, synchronous signal, polarity reversal signal, etc.) based on an input synchronization signal 400. The source driver circuit 305 is inputted by first and second SPD 401, 402 and first and second CLD 403, 404. The gate driver circuit 304 is inputted by SPS 405 and CLS 406. The video signal processing circuit 310 is inputted by FRP 407.

Figure 7:
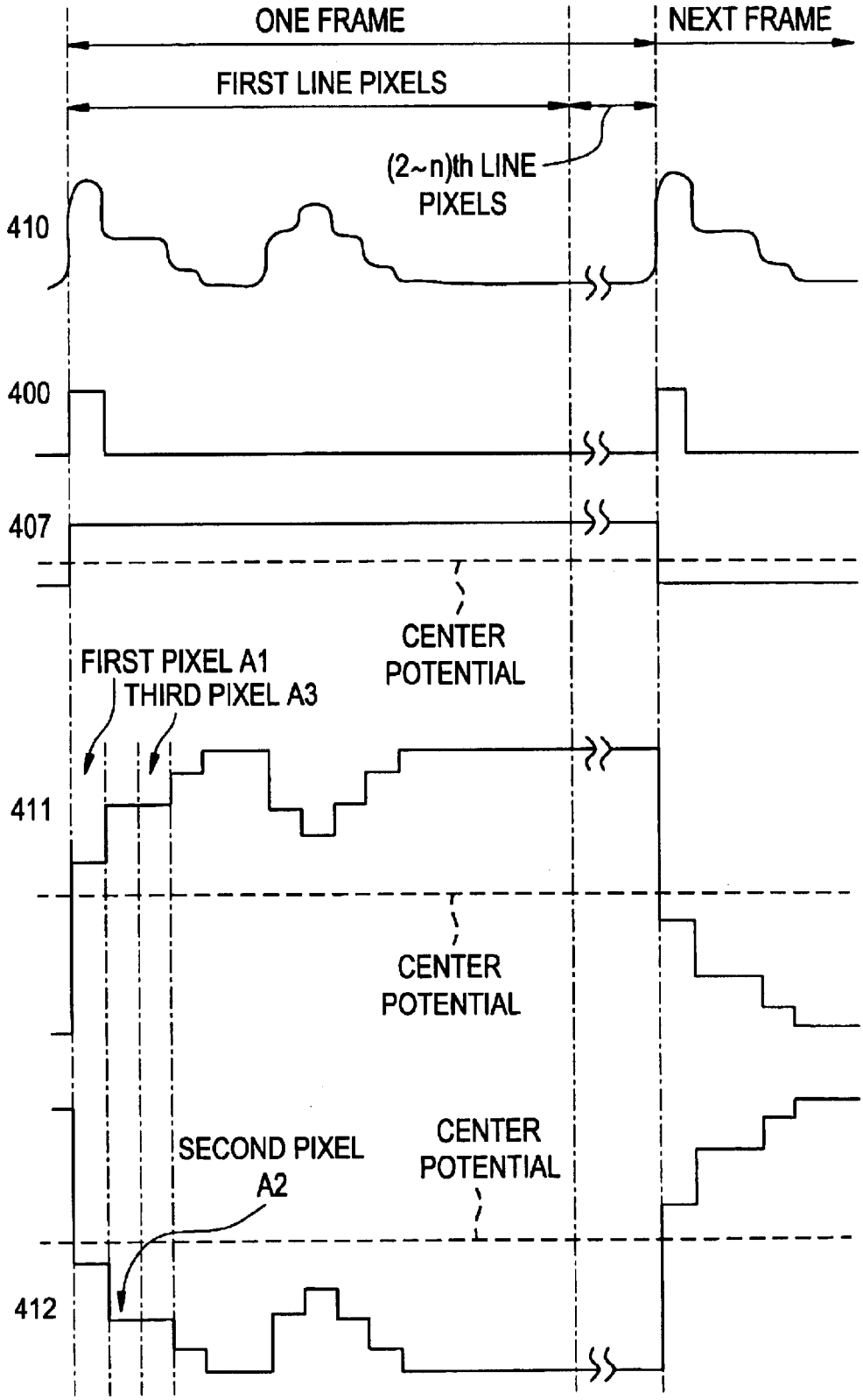
FIG. 7 is signal waveforms showing a synchronization signal, a polarity inversion signal, an input video signal and a first and a second alternating current video signal of Embodiment 1.

The video signal processing circuit 310 processes an input video signal 410 and output a first alternating current video signal 411 and second alternating current video signal 412 to the source driver circuit 305. There are illustrated in FIG. 7 signal waveforms as an example of an input video signal 410, synchronization signal 400, polarity reversal signal (FRP) 407, first alternating current video signal 411 and second alternating current video signal 412.

The video signal processing circuit 310 in this embodiment has an A/D converter 311 and a correction circuit 312. The correction circuit 312 has two line systems of video signal output lines wherein the output signal lines are respectively connected with D/A converters 313, 314. The D/A converters 313, 314 has their outputs respectively connected with amplifying circuits 315, 316.

The video signal processing circuit 310 is inputted by an input video signal 410 that is an analog signal of RGB. In the A/D converter 311, an input video signal 410 is converted into a digital signal that is easy to perform signal correction. The input video signal may employ a digital RGB signal in place of an analog RGB signal. In such a case, the A/D converter 311 is unnecessary.

The digitized video signal is inputted to the correction circuit 312. In the correction circuit 312, the input video signal (digital signal) is subjected to various corrections by arithmetic operations. In principal gamma correction is carried out for conversion into a signal suited for display on the liquid crystal panel. The gamma-corrected signal is divided into two digital signals of first and second corrected, signals 413, 414 to be outputted.

The first and second corrected signals 413, 414 are created such that they become alternating current signals with a polarity-reversed relation, when the first and second corrected signals 413, 414 are converted into analog signals. The changing of signals into the alternating current signals is performed based on the timing of FRP 407 created by the control circuit 320. Meanwhile, it is preferred that the correction circuit 312 is configured with a memory circuit to temporarily memorize an input signal and a signal delay circuit to correct a phase shift caused by dividing into two signals.

The corrected signals 413, 414 outputted from the correction circuit 312 are respectively inputted to the D/A converter 313, 314 where they are converted into analog signals. These analog signals are in a relation that they are made in alternating current forms and that the polarity are reversed each other. These two signals are created by the correction circuit 312 such that the output analog signals of the D/A converters 313, 314 are in an inverted relation in polarity.

The first corrected signal 413 and the second corrected signal 414 outputted from the correction circuit 312 are respectively converted into analog signals by the corresponding D/A converters 313, 314. The analog signals outputted from the D/A converters 313, 314 are inputted to amplifying circuits 315, 316. In the amplifying circuits 315, 316, the input analog signals are amplified in voltage value to a magnitude suited for the liquid crystal panel (−5V to 5V) and outputted as first and second alternating current video signals 411, 412 to the source driver circuit 305.

In the signal processing circuit 310, the two amplifying circuits 315, 316 are in a final output stage to the source driver circuit 305. Similarly to FIG. 2, in this embodiment, respective peaking processing circuits are connected to output terminals of the amplifying circuits 315, 316. With such a structure, the corrected signals by the correction circuit 312 can be reproduced with fidelity into first and second alternating current video signals 411, 412 as analog signals, giving possible high quality and high image quality display. Incidentally, feedback circuits may be connected to outputs of the amplifying circuits 315, 316 to configure the feedback circuits by peaking processing circuits as shown in FIG. 4.

In the present embodiment, the two D/A converters and the two amplifying circuits were used in number corresponding to the two signal lines in order to prevent a phase shift between the first and second alternating current video signals 411, 412 from occurring. However, the number of the D/A converter and amplifying circuits may be 2n (n is a positive number) so long as being allowed in circuit arrangement.

The two alternating current video signals 411, 412 thus obtained are inputted to the source driver circuit. This makes it possible to decrease the operating frequency of the shift register to a half as compared with a case inputting one signal to the source driver circuit.

In the present embodiment, in the amplifying circuit 315, 316 as shown in FIG. 2, a peaking processing circuit is connected to an amplifier closest to its output terminal. With this structure, it is possible to compensate for decrease of the gain in the alternating current video signals 411, 412 at the pixel electrode. Also, by inputting to the source driver circuit 305 the two alternating current video signals 411, 412 that have the same image information (the same voltage) and are in an inverted relation in polarity, the inverted period can be reduced in the alternating current video signals 411, 412 and the video signals 411, 412 can be prevented from causing a phase shift or noise, enabling high quality display.

The method for driving the liquid crystal panel is explained hereinbelow using FIG. 6 to FIG. 8 together with FIG. 5.

The gate driver circuit 304 includes a vertical shift register :controllable of scan direction, a level shifter to convert an output signal of the shift register into a required voltage, an output buffer circuit and so on. The output buffer circuit in the present embodiment is a circuit to amplify or impedance-convert a held voltage to apply it to the display section. Various circuits including an inverter as a typical configuration may be considered.

The source driver circuit 305 includes a two-phase horizontal shift register controllable of scanning direction and a sampling circuit for sampling video signals to drive the pixel portions. The sampling circuit is configured by a plurality of switching TFTs and a capacitor. FIG. 6 shows a circuit diagram of a source driver circuit 305 and pixel matrix area.

Figure 6:
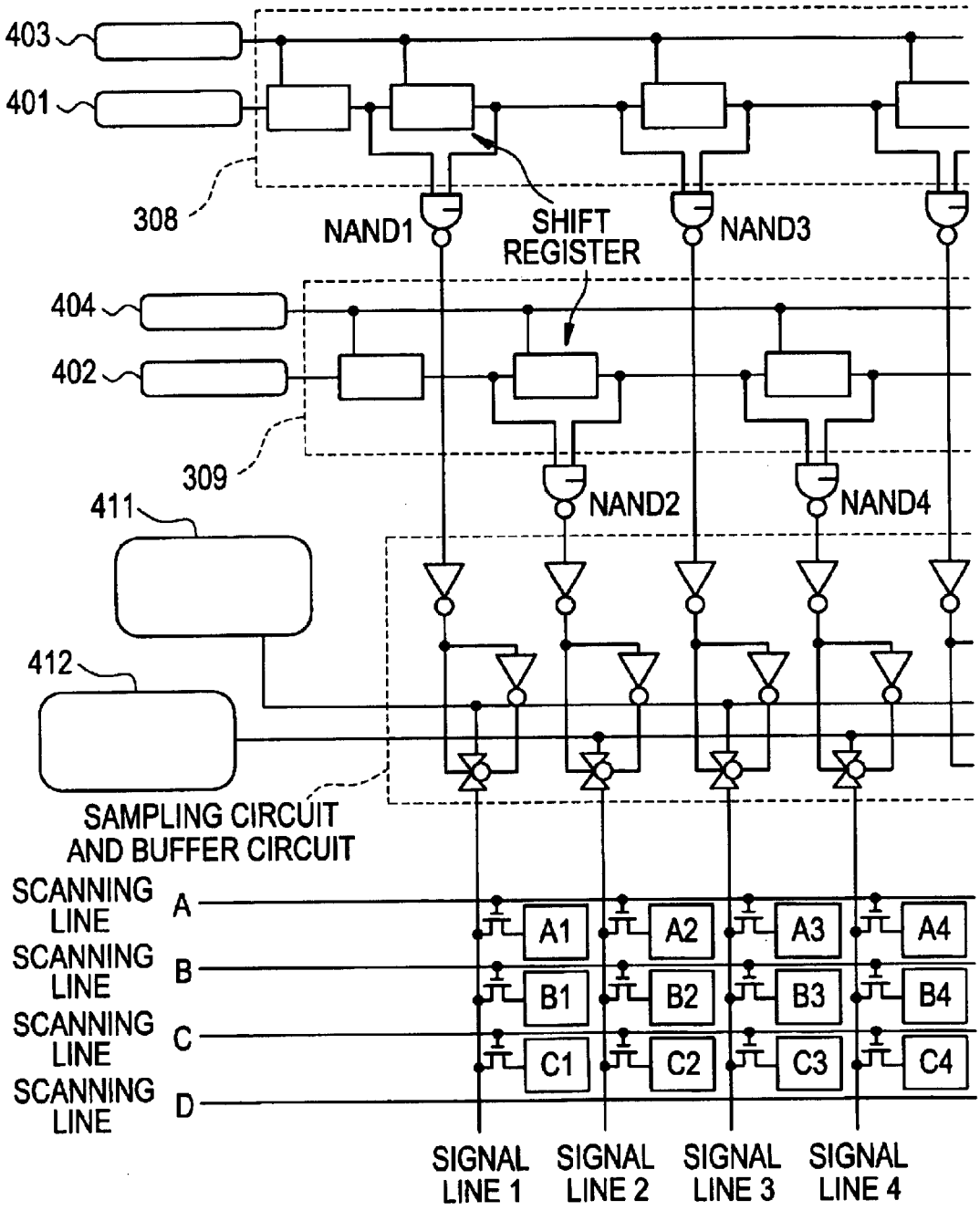
FIG. 6 is a partial diagram including a source driver circuit and pixel matrix area of Embodiment 1.

The source driver circuit 305, as shown in FIG. 6, can be configured by various circuits including a typical configuration of a shift register, level shifter, switch, inverter, output buffer circuit and so on. This is not limited to the present embodiment configuration provided that it is a circuit to sample and apply video signals to the display section. It should be noted that the signal lines are in the same number as the number of horizontal pixel electrodes of the liquid crystal panel. Similarly, the number of scanning lines is the same as the number of vertical pixel electrodes.

FIG. 7 shows a signal waveforms of the synchronization signal 400, FRP 407, input video signal 410, and the first and second alternating current video signals 411, 412 as outputs of the video signal processing circuit 310.

Figure 8:
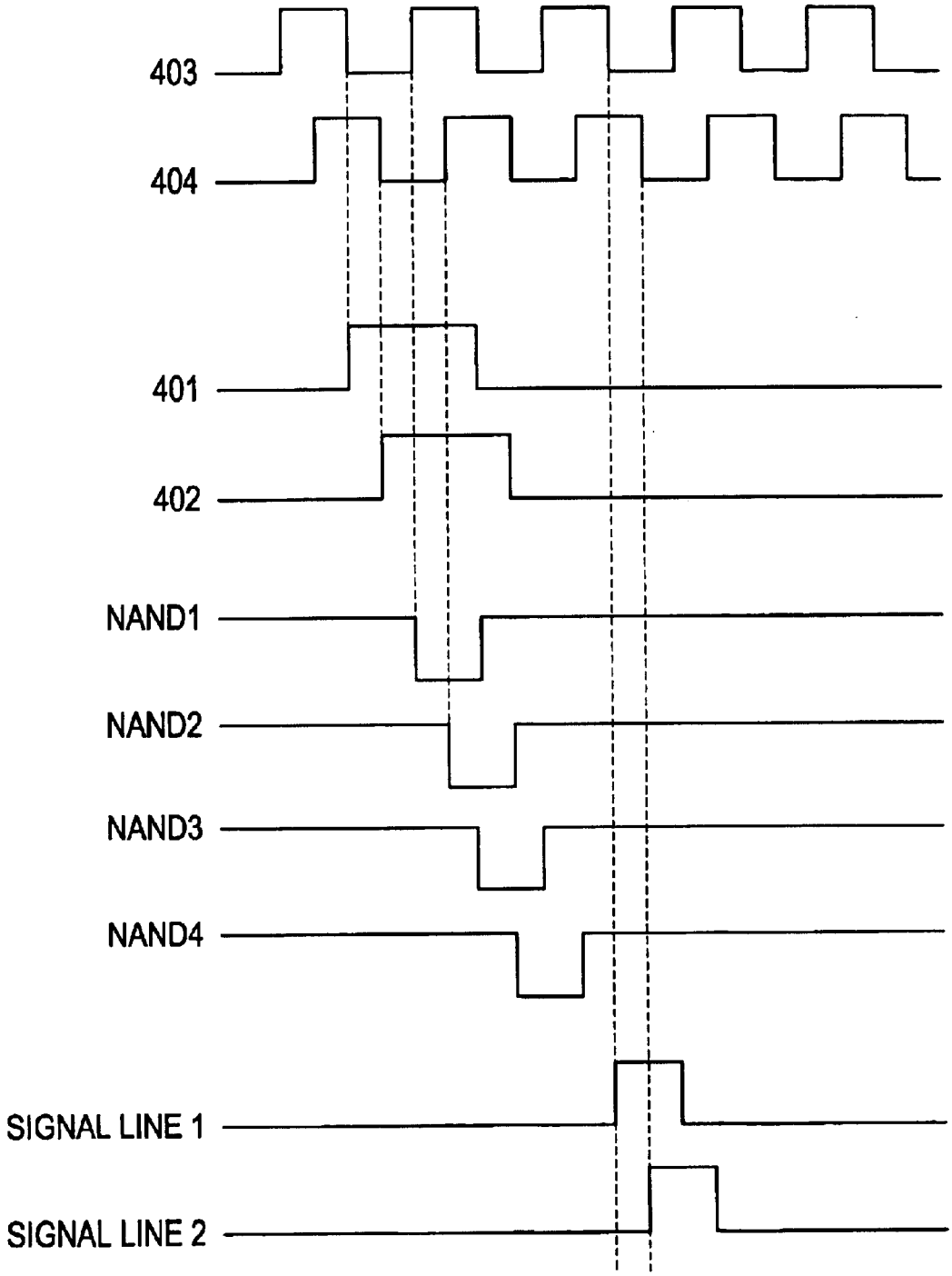
FIG. 8 is a timing chart on signals in the source driver circuit of Embodiment 1.

FIG. 8 shows a timing chart for the source driver circuit 305. The source driver circuit 305 is inputted by two video signals from the video signal processing circuit 310, and a start pulse signal, clock signal, horizontal synchronization signal, etc. from the control circuit 320.

The input video signal 410 is subjected to various corrections (liquid crystal display gamma correction, camera gamma correction, corrections suited for user's requirement, etc.) in the video signal processing circuit 310, outputting alternating current video signals 411, 412. As shown in FIG. 7, FRP 407 is inverted in polarity every frame. The alternating current video signals 411, 412 are alternating current signals having a center potential as a reference, which have a same inversion period of every 1 frame as FRP 407. The alternating current video signals 411, 412 are signals having respective potentials that are symmetric with respect to the center potential, being signals in an inverted relation in polarity to each other.

The input video signal 410 herein was substantially made into an alternating current form by the correction circuit of the video signal processing circuit 310, i.e. making into the alternating current form was by processing a digital signal. It can be easily understood that the two alternating current video signals 411, 412 can be in an inverted relation in polarity to each other even by making into an alternating current form after converting into analog by the D/A converters 313, 314. Making a digital signal into an alternating current form can reduce the burden on the amplifying circuits 415, 416 as compared with making an analog signal into an alternating current form.

The first and second alternating current video signals 411, 412 are respectively inputted to the sampling circuits of the source driver circuit 305. In a first shift register section, a first alternating current video signal 411 sampled by the sampling circuit is outputted onto an odd-numbered signal line, according to CLD 403 and SPD 401. In a second horizontal shift register section 308, a second alternating current video signal 412 sampled by the sampling circuit is outputted onto an even-numbered signal line, according to inputted second SPD 402 and second CLD 404.

Where providing the two-phase shift register sections 308 and 309, the shift-register operational frequency can be reduced to a half (½) as compared with a case using only one of shift registers as clear from a waveform diagram in FIG. 7.

Although the present embodiment showed the example that an analog;video signal was divided into two, the signal even if divided into n (n is an even number) may be applied to the present invention. With such a structure, the video signal can be further reduced in frequency. Where the alternating current signal is n divided, an n-phase shift registers may be employed. This results reducing the shift-register operational frequency to 1/n as compared with a case using only one of shift registers.

The operation of pixels applied by first and second alternating current video signals 411, 412 is explained with reference to FIG. 6 showing one example of peripheral circuits of the source driver circuit 305.

If a signal voltage is applied only to a scanning line (TFT close to an intersection is turned on), pixel TFTs are turned on. A first alternating current video signal 411 is applied onto a signal line 1 in synchronism with the scanning signal. A positive signal is applied to a pixel electrode Al connected to the odd-numbered signal line 1.

Similarly, a second alternating current video signal 412 is then applied to a signal line 2 in synchronism with the scanning signal. A negative signal is applied to a pixel electrode A2 connected to the even-numbered signal line 2.

By the repetition of this operation, positive signals are applied in order to pixel electrodes (A1, B1, C1 and A3, B3, C3), while negative signals are applied to pixel electrodes (A2, B2, C2 and A4, B4, C4).

After 1-frame period, when a signal voltage is again applied to the scanning line A (TFT close to an intersection is turned on), the first alternating current video signal 411 and the second alternating current video signal 412 are inverted in polarity as shown in FIG. 7, the polarity of the signal applied to the pixel electrode is reversed. By repeating the operation, the amount of transmission light through the liquid crystal varies depending on the potential of the pixel electrode, whereby the pixels as a whole display an image.

In this manner, source line inversion drive is conducted. In the present embodiment, alternating drive (source line inversion) can be performed by using video signals that are polarity-inverted only every screen. That is, with the alternating drive method in the present embodiment, the inverted period of the video signal upon source line inversion drive display is greatly increased from a conventional one-pixel write period to the one-screen write period. Due to this, the signal processing circuit and the source driver circuit are reduced in power consumption and decreased in phase shift and noise problem.

In the liquid crystal display device of the present embodiment structured by a HDTV specification having pixels 1024×1890 (rear-projection liquid crystal display device to be stated later in embodiment 4), the number of TV lines was increased in a test-chart horizontal direction by the present-embodiment peaking processing circuit. Where the peaking processing circuit was not connected, the horizontal number of TV lines was 600. This, however, could be increased up to 800. Where black and white stripe bars were displayed, the white and black stripes could be recognized with even increased horizontal drive frequency of up to 18 MHz.

[Embodiment 2]

In Embodiment 1, source line inversion drive was conducted with the one-frame period of the video signal inversion period. In the present embodiment, device structure is the same as that of Embodiment 1. One example is shown wherein dot inversion drive was conducted with one-horizontal-scanning period given for the video signal inversion period.

The dot inversion is a alternated drive method having a merit that flicker is least conspicuous due to the polarities of video signal voltages are in inversion between adjacent pixels.

The dot inversion drive has a characteristic that within a frame the polarities of video signal voltages to be applied are surely in an inverted relation between vertically and horizontally adjacent pixel electrodes. Furthermore, in a next frame the pixel polarity is inverted.

Although in the present embodiment the drive voltage inversion period was the one-horizontal-scanning period, the inversion period may use a period other than this. For example, it may be a two-horizontal-scanning period or three-horizontal-scanning period.

In the conventional example, dot inversion has required video signal polarity inversion for each pixel. However, dot inversion drive is possible by inputting to the panel a plurality of video signals (mutually in an inverted relation) with polarities inverted every one-horizontal-scanning period, with using a similar device structure to that of Embodiment 1.

That is, in the present embodiment dot inversion drive is implemented with video signals less in number of times of polarity inversions (inverted in polarity every one-horizontal-scanning period) as compared with the conventional example with polarity inversion for each pixel. Thus, accurate alternated drive was possible improving panel reliability.

Due to this, the present embodiment can provide less-flickered display high in image quality and definition as compared with Embodiment 1. Furthermore, power consumption can be largely decreased as compared with the conventional, similarly to Embodiment 1.

[Embodiment 3]

Figure 9:
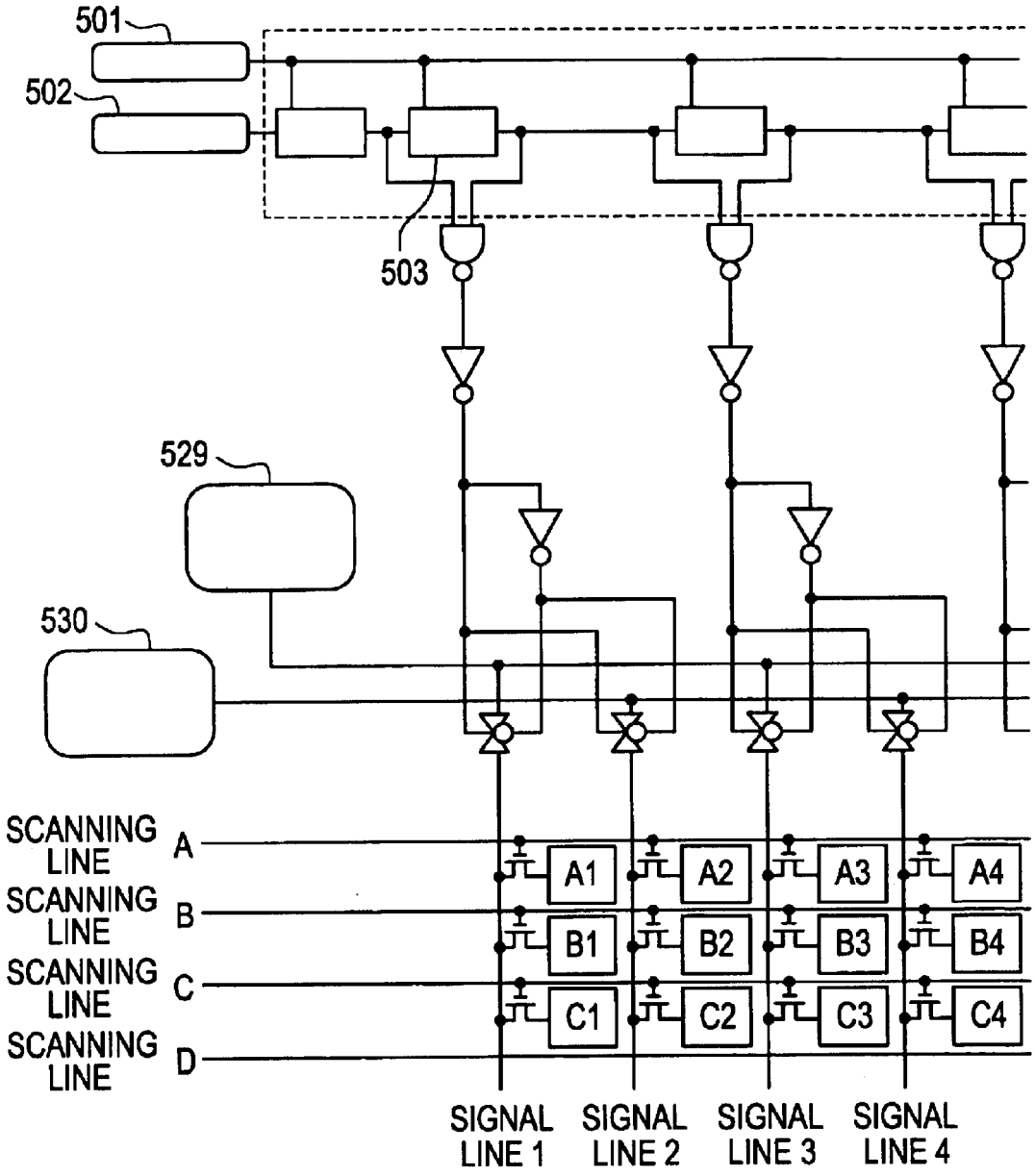
FIG. 9 is a partial diagram including a source driver circuit and a pixel matrix area of Embodiment 3.

Although in Embodiments 1 and 2 examples using two-phase shift registers were shown, this embodiment demonstrates an application example using one-phase shift register. FIG. 9 shows a partial circuit diagram of a source driver circuit and pixel matrix circuit according to the present embodiment.

In FIG. 9, 501 is a clock signal, 502 a start pulse, 503 a shift register, 529 a first analog video signal and 530 a second analog video signal. Using video signals as were shown in Embodiment 1 or 2 (polarity inversion period of every frame or a one-horizontal-scanning period), the source driver circuit of FIG. 9 also can cause source line inversion or dot inversion drive. With this configuration, integration for the drive circuits can be achieved.

[Embodiment 4]

Figure 10A:
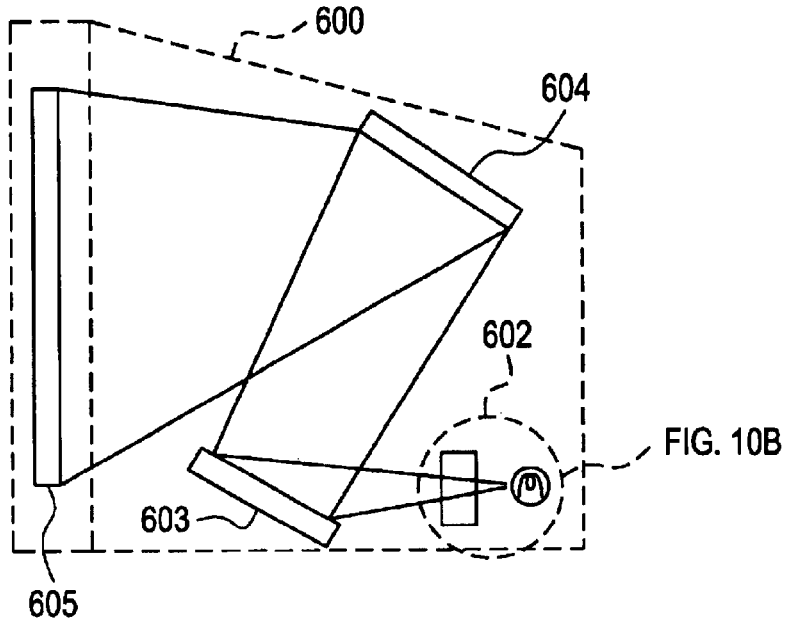
FIGS. 10A and 10B are schematic structural views of a rear projector type display device of Embodiment 4.
Figure 10B:
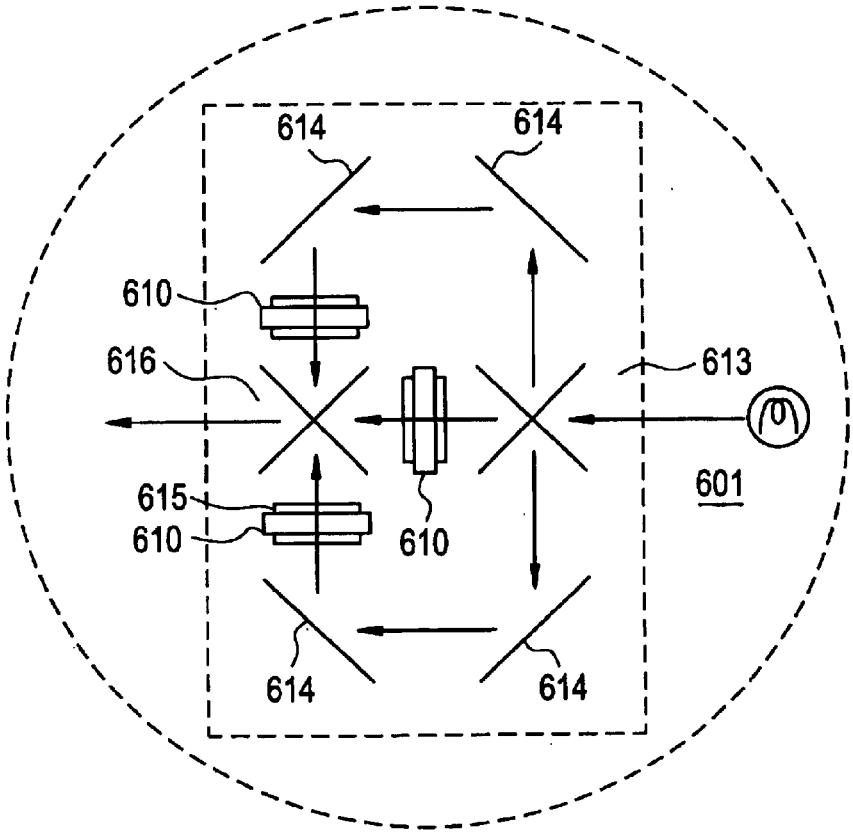

FIG. 10A shows an outline of a projection type image display unit (rear projector) using a three-plate optical system. Numeral 600 shows a main body, numerals 603 and 604 show mirrors and numeral 605 shows a screen. FIG. 10B shows a magnification of a portion 602 enclosed in a broken line. In the projector in this embodiment, the projection light projected from a light source 601 is separated into three primary colors R, G and B by an optical system 613, and introduced through mirrors 614 to three liquid crystal display panels 610 to display respective color images. Each of the liquid crystal display panels 610 is constituted by thin film transistors. The respective light components modulated by the liquid crystal display panels are composited by an optical system 616, being projected as a color image on the screen 605. Incidentally, 615 is a polarizing plate.

It is possible to obtain images with broad gamma-characteristic freedom if the video signal processing circuit carries out corrections, for each color, such as liquid crystal display gamma correction, camera gamma correction, human-sight suited correction, observer's demand met correction, and so on. Therefore, the use of the present rear projector makes it possible to display images preferred in balance of tone, hue and resolution.

Meanwhile, the present invention is not limited to a liquid crystal display device integral with a driver circuit, but applicable to so-called an externally-mounted display device having a driver circuit formed on a substrate different from the liquid crystal panel.

It should be noted that the structures of the shift register circuit, the buffer circuit, the sampling circuit, the memory circuit, for example, shown in Embodiments 1 to 3 are mere one examples. It is needless to say that they can be suitably modified if similar functions are provided.

Because in the present invention the video signal processing circuit has a peaking processing circuit connected to an output of an amplifier connected to an output end of the liquid crystal panel, improvement was made for the voltage gain on the pixel electrodes reduced due to liquid panel impedance characteristics. This makes it possible for a liquid crystal display device with increased pixels and high frequency drive to reduce graying image (muddy color in color) and display with high definition. The present invention is effective particularly for a liquid crystal display device of a high definition type having horizontally pixels in number of one thousand or more, such as in HDTV, XGA or SXGA rating.

What is claimed is:

1. An active matrix display device, comprising:

a plurality of pixels arranged in a matrix form;

a first driver circuit connected to scanning lines;

a second driver circuit connected to signal lines;

at least one switching element provided in one of said pixels wherein a gate electrode of the switching element is connected to one of the scanning lines and one of a source or a drain of the switching element is connected to one of the signal lines;

a video signal processing circuit for alternating video signals and outputting a plurality of alternating current video signals to said second driver circuit, said alternating current video signals including two alternating current signals in an inverted relation to each other; and a control circuit for creating control signals to control said first driver circuit said second driver circuit and said video signal processing circuit;

wherein said video signal processing circuit includes an amplifier and a circuit for effecting a peaking process connected to an output of said amplifier, and wherein said two alternating current signals are respectively reversed in polarity every one horizontal scanning period of said first driver circuit.

2. An active matrix display device according to claim 1, wherein said amplifier and said circuit for effecting the peaking process constitute an inversion processing circuit which outputs an alternating current video signal.

3. An active matrix display device according to claim 1, wherein said circuit for effecting the peaking process is a feedback circuit of said amplifier.

4. An active matrix display device according to claim 1, wherein one of said control signals is inputted to an inversion processing circuit including said amplifier and said circuit for effecting the peaking process.

5. An active matrix display device comprising:

a plurality of pixels arranged in a matrix form;

a first driver circuit connected to scanning lines;

a second driver circuit connected to signal lines;

at least one switching element provided in one of the pixels wherein a gate of the switching element is connected to one of the scanning lines and one of a source or a drain of the switching element is connected to one of the signal lines;

a video signal processing circuit for alternating video signals and outputting a plurality of alternating current video signals to said second driver circuit; and a control circuit for creating control signals to control said first driver circuit, said second driver circuit and said video signal processing circuit;

wherein said alternating current signals includes two alternating current signals in an inverted relation to each other, and wherein said video signal processing circuit includes an amplifier and a circuit for effecting a peaking process connected to an output of said amplifier, wherein said two alternating current signals are respectively reversed in polarity every one horizontal scanning period of said first driver circuit.

6. An active matrix display device according to claim 5, wherein said amplifier and said circuit for effecting the peaking process constitute an inversion processing circuit which outputs an alternating current video signal.

7. An active matrix display device according to claim 5, wherein said circuit for effecting the peaking process is a feedback circuit of said amplifier.

8. An active matrix display device according to claim 5, wherein one of said signals is inputted to an inversion processing circuit including said amplifier and said circuit for effecting the peaking process.

9. A projection type image display unit comprising:

a plurality of pixels arranged in a matrix form;

a first driver circuit connected to scanning lines;

a second driver circuit connected to signal lines;

at least one switching element provided in one of the pixels wherein a gate of the switching element is connected to one of the scanning lines and one of a source or a drain of the switching element is connected to one of the signal lines;

a video signal processing circuit for alternating video signals and outputting a plurality of alternating current video signals to said second driver circuit, said alternating current video signals including two alternating current signals in an inverted relation to each other; and a control circuit for creating control signals to control said first driver circuit, said second driver circuit and said video signal processing circuit;

wherein said video signal processing circuit includes an amplifier and a circuit for effecting a peaking process connected to an output of said amplifier, wherein said two alternating current signals are respectively reversed in polarity every one horizontal scanning period of said first driver circuit.

10. A projection type image display unit according to claim 9, wherein said amplifier and said circuit for effecting the peaking process constitute an inversion processing circuit which outputs an alternating current video signal.

11. A projection type image display unit according to claim 9, wherein said circuit for effecting the peaking process is a feedback circuit of said amplifier.

12. A projection type image display unit according to claim 9, wherein one of said control signals is inputted to an inversion processing circuit including said amplifier and said circuit for effecting the peaking process.

13. A projection type image display unit comprising:

a plurality of pixels arranged in a matrix form;

a first driver circuit connected to scanning lines;

a second driver circuit connected to signal lines;

at least one switching element provided in one of the pixels wherein a gate of the switching element is connected to one of the scanning lines and one of a source or a drain of the switching element is connected to one of the signal lines;

a video signal processing circuit for alternating video signals and outputting a plurality of alternating current video signals to said second driver circuit; and a control circuit for creating control signals to control said first driver circuit, said second driver circuit and said video signal processing circuit;

wherein said alternating current signals includes two alternating current signals in an inverted relation to each other, and wherein said video signal processing circuit includes an amplifier and a circuit for effecting a peaking process connected to an output of said amplifier, wherein said two alternating current signals are respectively reversed in polarity every one horizontal scanning period of said first driver circuit.

14. A projection type image display unit according to claim 13, wherein said amplifier and said circuit for effecting the peaking process constitute an inversion processing circuit which outputs an alternating current video signal.

15. A projection type image display unit according to claim 13, wherein said circuit for effecting the peaking process is a feedback circuit of said amplifier.

16. A projection type image display unit according to claim 13, wherein one of said control signals is inputted to an inversion processing circuit including said amplifier and said circuit for effecting the peaking process.

17. An active matrix display device comprising:

a plurality of pixels arranged in a matrix over a substrate;

a plurality of switching elements provided over said substrate for switching said pixels;

a plurality of signal lines provided over said substrate;

a source driver circuit provided over said substrate for supplying alternating video signals to said plurality of switching elements through said plurality of signal lines, said alternating video signals including two alternating current signals in an inverted relation to each other; and an inversion processing circuit for producing said alternating video signal to said source driver circuit, wherein said inversion processing circuit comprises an amplifier and a peaking processing circuit connected to an output of said amplifier, wherein said two alternating current signals are respectively reversed in polarity every one horizontal scanning period.

18. An active matrix display device according to claim 17, wherein said plurality of switching elements comprise thin film transistors.

19. An active matrix display device according to claim 17, wherein said source driver circuit comprises thin film transistors.

20. An active matrix display device according to claim 17, wherein said active matrix display device comprises a gate driver circuit.

21. An active matrix display device according to claim 17, wherein said video signal has a frequency of 20 to 30 MHZ and said active matrix display device is a HDTV.

22. An active matrix display device comprising:

a plurality of pixels arranged in a matrix over a substrate;

a plurality of switching elements provided over said substrate for switching said pixels;

a plurality of signal lines provided over said substrate;

a source driver circuit provided over said substrate for supplying alternating video signals to said plurality of switching elements through said plurality of signal lines, said alternating video signals including two alternating current signals in an inverted relation to each other;

an inversion processing circuit for producing said alternating video signal, an amplifier connected to said inversion processing circuit for amplifying said alternating video signal; and a peaking processing circuit connected to said amplifier for performing peaking process to said alternating video signal, wherein said source driver circuit is connected to said peaking processing circuit, and wherein said two alternating current signals are respectively reversed in polarity every one horizontal scanning period.

23. An active matrix display device according to claim 22, wherein said plurality of switching elements comprise thin film transistors.

24. An active matrix display device according to claim 22, wherein said source driver circuit comprises thin film transistors.

25. An active matrix display device according to claim 22, wherein said active matrix display device comprises a gate driver circuit.

26. An active matrix display device according to claim 22, wherein said video signal has a frequency of 20 to 30 MHZ and said active matrix display device is a HDTV.

* * * * *